United States Patent [19]

Fernitz

[11] 4,096,895

[45] Jun. 27, 1978

[54] HAMMER-TYPE TOOL

[75] Inventor: Kenneth Fernitz, Waterloo, Wis.

[73] Assignee: The Raymond Lee Organization, Inc., New York, N.Y. ; a part interest

[21] Appl. No.: 849,007

[22] Filed· Nov. 7, 1977

[51] Int. Cl.[2] ..... B25C 1/00; B25D 1/00

[52] U.S. Cl. ..... 145/29 R; 145/2 R; 145/3; 145/36

[58] Field of Search ..... 145/29 R, 36, 2 R, 3

[56] References Cited

U.S. PATENT DOCUMENTS

| | | | |
|---|---|---|---|
| 128,463 | 7/1872 | Clarke et al. | 145/29 R |
| 270,883 | 1/1883 | Bailey | 145/2 R |
| 2,039,900 | 5/1936 | Hargrave | 145/3 |

FOREIGN PATENT DOCUMENTS

| | | | |
|---|---|---|---|
| 501,140 | 11/1954 | Italy | 145/29 R |
| 585,085 | 11/1958 | Italy | 145/36 |

*Primary Examiner*—James L. Jones, Jr.
*Assistant Examiner*—J. T. Zatarga
*Attorney, Agent, or Firm*—Daniel Jay Tick

[57] ABSTRACT

A shaft-type handle has protruding parts parallel to its axis in one end area thereof. A pair of bores extend through the protruding portions in spaced relation parallel to the axis of the handle. A hammer-type head is mounted on the end area of the handle and extends at right angles to the axis of the handle. A pair of elongated screws extend through bores formed through a metal plate at the end of the handle at the end area and through the bores through the protruding portions and are secured via lock washers and nuts. The plate overlaps the head for a predetermined border area extending beyond the end area.

1 Claim, 3 Drawing Figures

HAMMER-TYPE TOOL

BACKGROUND OF THE INVENTION:

The present invention relates to a hammer-type tool.

Objects of the invention are to provide a hammer-type tool of simple structure, which is inexpensive in manufacture, assembled and disassembled with facility and convenience, and functions efficiently, effectively and reliably to secure a hammer-type head such as a hammer, an axe, or the like, to its handle in a manner whereby the head cannot slip off the handle in the manner of hammers, axes, and the like, which are forced onto their handles.

BRIEF DESCRIPTION OF THE DRAWINGS:

In order that the invention may be readily carried into effect, it will now be described with reference to the accompanying drawings, wherein.

DETAILED DESCRIPTION OF THE INVENTION

Figure 1:
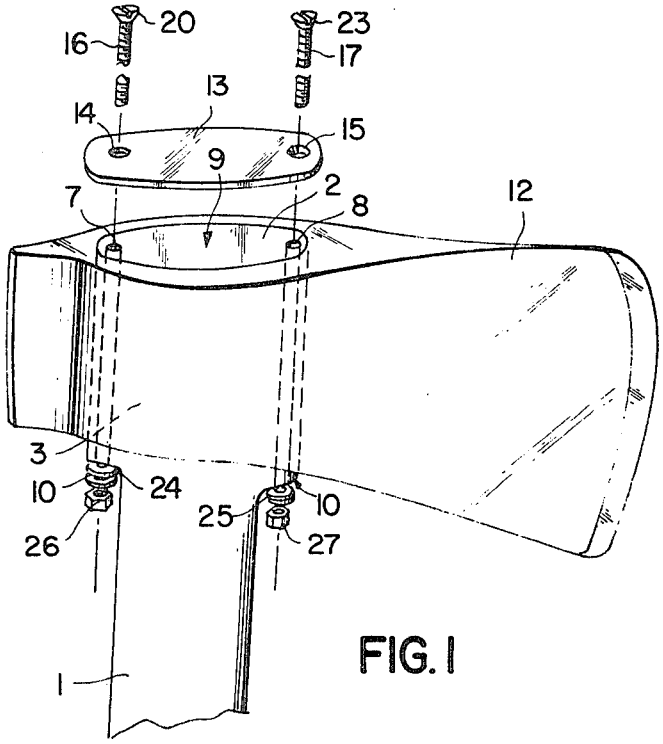
FIG. 1 is a perspective exploded view of an embodiment of the hammer-type tool of the invention.

The hammer-type tool of the invention comprises a shafttype handle 1 having spaced opposite ends, one end 2 of which is shown in the FIGS. The handle 1 has substantially the same cross-sectional area except for an end area 3 at the one end 2 of the handle. The end area 3 has a cross-sectional area different from that of the remainder of the handle in a manner whereby the end area extends beyond the remainder of the handle at substantially diametrically opposite points in a pair of spaced opposite protruding portions 4 and 5 (FIG. 3) extending substantially parallel to the axis 6 of the handle (FIG. 3).

The end area 3 has a pair of bores 7 and 8 (FIGS. 1 and 3) formed therethrough extending through the protruding portions 4 and 5 in spaced relation substantially parallel to the axis 6 of the handle. Each of the bores 7 and 8 opens at the opposite ends 9 and 10 of the corresponding protruding portion (FIGS. 1 and 3).

Figure 2:
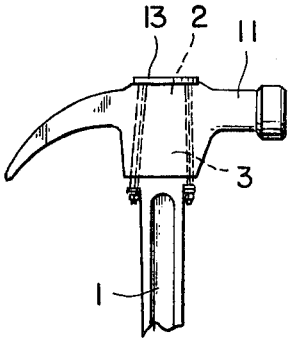
FIG. 2 is a view, on a reduced scale, of a modification of the embodiment of FIG. 1.
Figure 3:
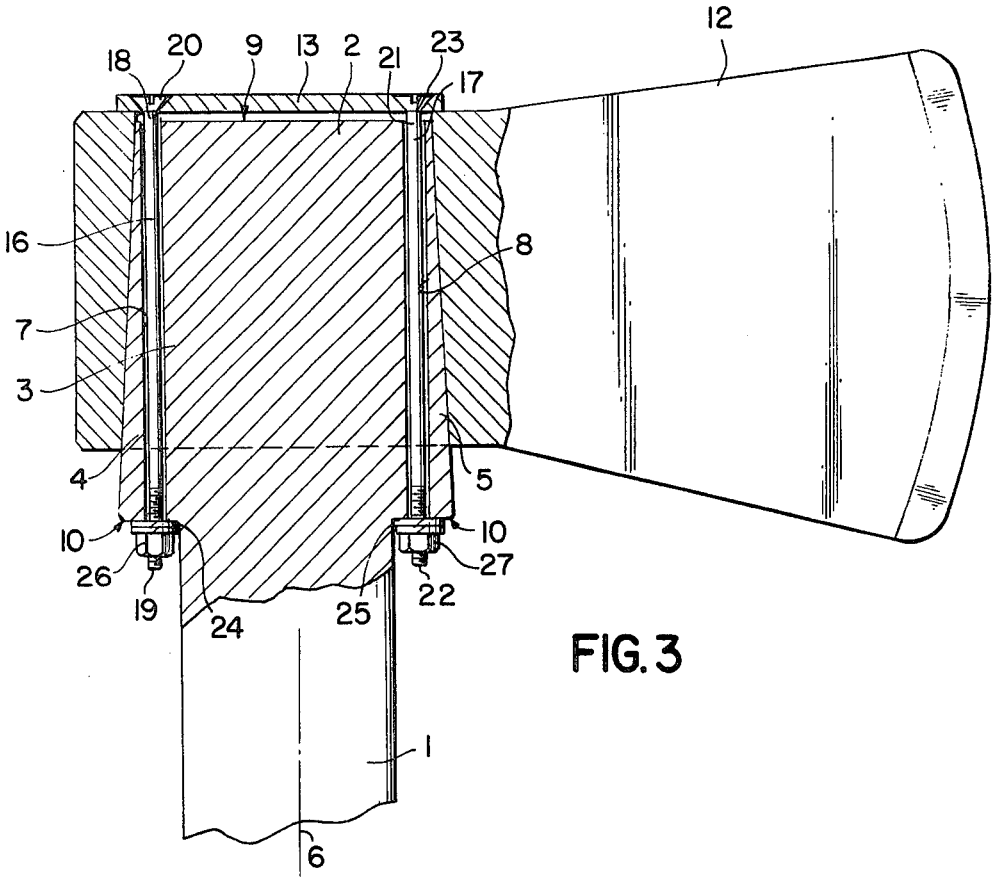
FIG. 3 is a view, on an enlarged scale, partly cut away and partly in section, of the embodiment of FIG. 1 in assembled condition.

A hammer-type head which may comprise a hammer 11, as shown in FIG. 2, an axe 12, as shown in FIGS. 1 and 3, or the like, is mounted on the end area 3 of the handle 1 and extends at substantially right angles to the axis 6 of said handle.

A metal plate 13 is provided at the end 2 of the handle 1 at which the end area 3 is provided. The metal plate 13 has larger dimensions than the cross-sectional area of the end area 3, so that said plate overlaps the head 11 or 12 for a predetermined border area extending beyond the said end area (FIGS. 1 and 3). The plate 13 also has a pair of holes 14 and 15 (FIG. 1) formed therethrough coinciding with the bores 7 and 8 through the protruding portions 4 and 5, respectively, of the end area 3.

An elongated screw 16 extends through the bore 7 through the end area 3 and the hole 14 through the metal plate 13 (FIGS. 1 and 2). An elongated screw 17 extends through the bore 8 through the end area 3 and the corresponding hole 3 through the metal plate 13 (FIGS. 1 and 3). The screw 16 has spaced opposite ends 18 and 19 with a head 20 at its end 18 (FIG. 3). The screw 16 has spaced opposite ends 18 and 19 with a head 20 at its end 18 (FIG. 3). The screw 17 has spaced opposite ends 21 and 22 with a head 23 at its end 21 (FIG. 3).

A lock washer 24 is provided on the screw 16 at its end 19, which end extends beyond the end area 3 of the handle 1 (FIG. 3). A lock washer 25 is provided on the screw 17 at its end 22, which end extends beyond the end area 3 of the handle 1 (FIG. 3).

A nut 26 is affixed to the end 19 of the screw 16, over the lock washer 24 (FIGS. 1 and 3). A nut 27 is affixed to the end 22 of the screw 17 over the lock washer 25 (FIGS. 1 and 3). Thus, the screws 16 and 17 secure the hammer-type head 11 or 12 to the handle 1 via the overlapping plate 13 (FIG. 3).

While the invention has been described by means of a specific example and in a specific embodiment, I do not wish to be limited thereto, for obvious modifications will occur to those skilled in the art without departing from the spirit and scope of the invention.

I claim:

1. A hammer-type tool, comprising a shaft-type handle having spaced opposite ends and substantially the same cross-sectional area except for an end area at one end of the handle, said end area having a cross-sectional area different from that of the remainder of the handle in a manner whereby the end area extends beyond the remainder of the handle at substantially diametrically opposite points in a pair of spaced opposite protruding portions extending substantially parallel to the axis of the handle, said end area having a pair of bores formed therethrough extending through the protruding portions in spaced relation substantially parallel to the axis of the handle, each bore opening at the opposite ends of the corresponding protruding portion;

a hammer-type head mounted on the end area of the handle and extending at substantially right angles to the axis of the handle;

a metal plate at the end of the handle at which the end area is provided, said metal plate having larger dimensions than the cross-sectional area of the end area so that it overlaps the head for a predetermined border area extending beyond said end area, and having a pair of holes formed therethrough coinciding with the bores through the protruding portions of said end area;

a pair of elongated screws each extending through a corresponding bore through the end area and a corresponding hole through the metal plate, each of the screws having a pair of spaced opposite ends with a head at one end;

a pair of lock washers each on a corresponding one of the screws at the other end thereof where it extends beyond the end area; and a pair of nuts each affixed to a corresponding one of the screws at the other end thereof, over the corresponding lock washer.

* * * * *